US005653104A

United States Patent [19]

Hamburg et al.

[11] Patent Number: 5,653,104

[45] Date of Patent: *Aug. 5, 1997

[54] ENGINE AIR/FUEL CONTROL SYSTEM WITH ADAPTIVELY ALIGNMENT OF A CATALYTIC CONVERTER'S PEAK EFFICIENCY WINDOW

[75] Inventors: Douglas Ray Hamburg, Bloomfield Hills; Dennis Craig Reed, Plymouth, both of Mich.

[73] Assignee: Ford Global Technologies, Inc., Dearborn, Mich.

[ * ] Notice: The term of this patent shall not extend beyond the expiration date of Pat. No. 5,598,703.

[21] Appl. No.: 559,953

[22] Filed: Nov. 17, 1995

[51] Int. Cl.[6] ..... F01N 3/00

[52] U.S. Cl. ..... 60/285; 60/274

[58] Field of Search ..... 60/285, 276, 274

[56] References Cited

U.S. PATENT DOCUMENTS 5,211,011 5/1993 Nishikawa et al. .
5,426,935 6/1995 Ogawa ..... 60/285
5,472,888 12/1995 Douta et al. ..... 60/276
5,492,094 2/1996 Cullen et al. ..... 60/285
5,499,500 3/1996 Hamburg et al. ..... 60/285
5,528,899 6/1996 Ono ..... 60/285
5,537,816 7/1996 Ridgway et al. ..... 60/285
5,544,481 8/1996 Davey et al. ..... 60/274

*Primary Examiner*—John T. Kwon
*Attorney, Agent, or Firm*—Allan J. Lippa

[57] ABSTRACT

An engine air/fuel control system is disclosed which is responsive to first and second exhaust gas oxygen sensors respectively positioned upstream and downstream of a catalytic converter. Air/fuel feedback control is disabled, and a rich offset to fuel flow is provided to cause a corresponding rich offset in engine air/fuel ratio. A predetermined time afterwards, a lean offset in fuel flow is provided. Air/fuel feedback control is reinitiated, and fuel delivery is biased with a rich fuel bias when the downstream sensor indicates excessively lean engine exhaust in response to the lean fuel offset and biased with a lean fuel bias when the downstream sensor indicates excessively rich exhaust gases in response to the rich fuel offset.

11 Claims, 5 Drawing Sheets

ENGINE AIR/FUEL CONTROL SYSTEM WITH ADAPTIVELY ALIGNMENT OF A CATALYTIC CONVERTER'S PEAK EFFICIENCY WINDOW

FIELD OF THE INVENTION

The present invention relates to engine air/fuel control systems.

BACKGROUND OF THE INVENTION

Engine air/fuel feedback control systems are known in which a feedback variable derived from an exhaust gas oxygen sensor trims fuel flow to the engine in an effort to maintain stoichiometric combustion. A two-state oxygen sensor is typically used in which the change in output state occurs at stoichiometry under ideal conditions. The system includes a three way catalytic converter which has a peak efficiency window at stoichiometry under ideal conditions. Optimal catalytic conversion of hydrocarbons, carbon monoxide, and nitrogen oxides occurs at the peak efficiency window.

The inventors herein have recognized numerous problems with the above approaches. For example, the transition in exhaust gas oxygen sensor output states may not occur at stoichiometry for all sensors or over the life of any particular sensor. Furthermore, the peak efficiency window may not occur at stoichiometry for all catalytic converters. Accordingly, engine air/fuel ratio may not occur at the converter's peak efficiency window, thus resulting in less than optimal conversion of engine exhaust.

SUMMARY OF THE INVENTION

An object of the invention claimed herein is to maintain engine air/fuel operation within the peak efficiency window of a catalytic converter.

The above object is achieved, and problems of prior approaches overcome, by an air/fuel control method for an engine responsive to first and second exhaust gas oxygen sensors positioned in the engine exhaust respectively upstream and downstream of a catalytic converter. In one particular aspect of the invention, the method comprises the steps of: generating a fuel flow signal to cause engine air/fuel operation near a desired air/fuel ratio; trimming the fuel flow signal by a feedback variable derived from the first sensor; disabling the trimming step and offsetting the fuel flow signal by a first value during a first predetermined time to cause a corresponding rich offset in engine air/fuel operation and offsetting the fuel flow signal during a second predetermined time by a second value to cause a corresponding lean offset in engine air/fuel operation; and biasing the fuel flow signal with a rich fuel bias when the second sensor indicates excessively lean engine exhaust in response to the lean fuel offset and biasing the fuel flow signal with a lean fuel bias when the second sensor indicates excessively rich exhaust gases in response to the rich fuel offset.

An advantage of the above aspect of the invention is that engine air/fuel operation is maintained within the peak efficiency window of a catalytic converter.

BRIEF DESCRIPTION OF THE DRAWINGS

The object and advantages described herein will be more fully understood by reading the following example of an embodiment in which the invention is used to advantage with reference to the drawings wherein:

FIGS. 2–4*a* and 4*b* are flow charts of various operations performed by a portion of the embodiment shown in FIG. 1.

DESCRIPTION OF AN EMBODIMENT

Figure 1:
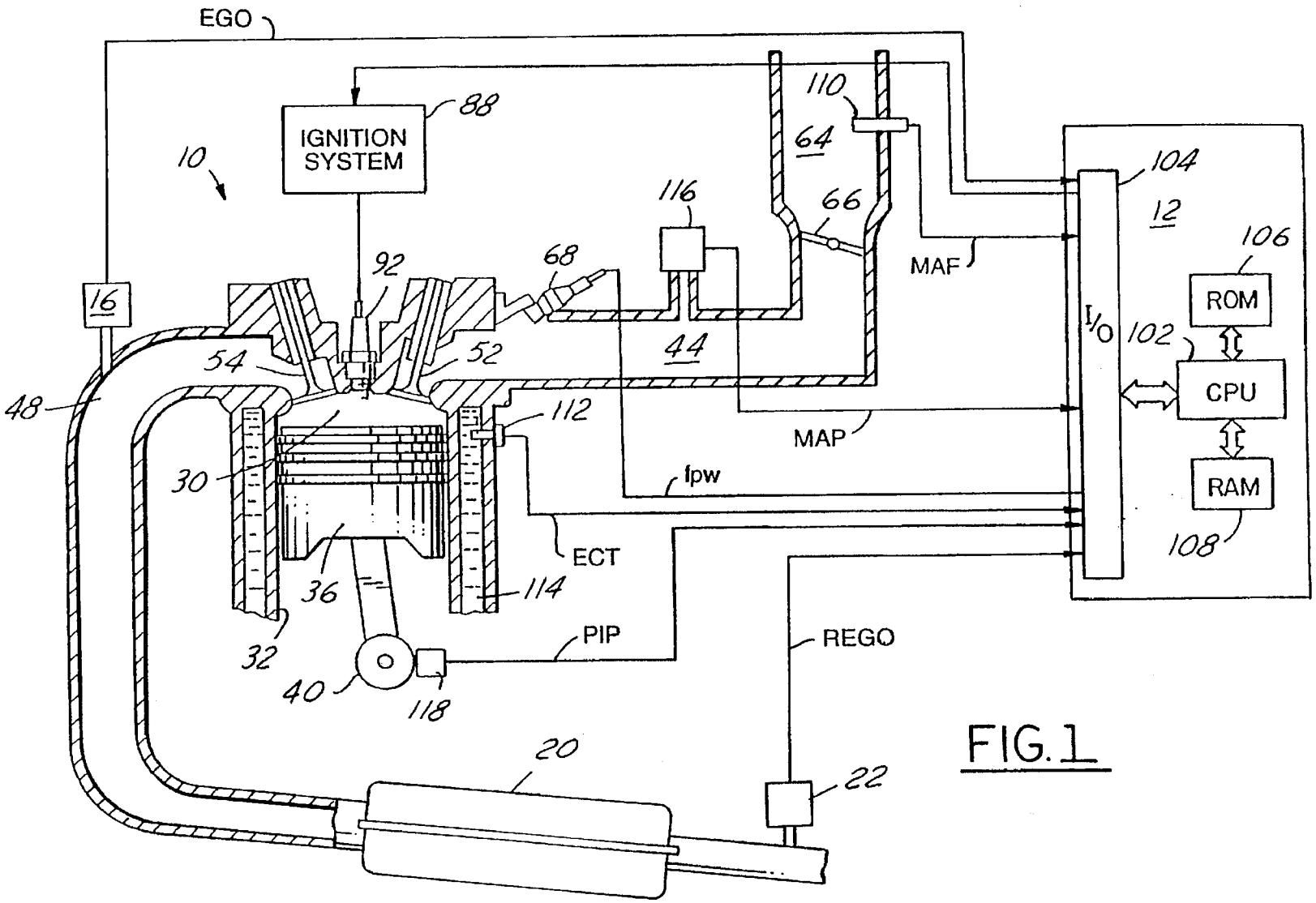
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Catalytic type exhaust gas oxygen sensors 16 and 22 are shown coupled to exhaust manifold 48 of engine 10 respectively upstream and downstream of catalytic converter 20. Sensors 16 and 22 respectively provide signals EGO and REGO to controller 12 which converts these signals into respective two-state signals EGOS and REGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected as stoichiometry which should fall within the peak efficiency window of catalytic converter 20. In general terms which are described later herein with particular reference to FIGS. 2–5, controller 12 provides engine air/fuel feedback control in response to signals EGOS and REGOS.

Continuing with FIG. 1, engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54.

Intake manifold 44 is shown communicating with throttle body 64 via throttle plate 66. Intake manifold 44 is also shown having fuel injector 68 coupled thereto for delivering liquid fuel in proportion to the pulse width of signal fpw from controller 12. Fuel is delivered to fuel injector 68 by a conventional fuel system (not shown) including a fuel tank, fuel pump, and fuel rail.

Conventional distributorless ignition system 88 provides ignition spark to combustion chamber 30 via spark plug 92 in response to controller 12.

Controller 12 is shown in FIG. 1 as a conventional microcomputer including: microprocessor unit 102, input/output ports 104, electronic memory 106 which is an electronically programmable memory chip in this particular example, random access memory 108, and a conventional data bus. Controller 12 is shown receiving various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling sleeve 114; a measurement of manifold pressure (MAP) from manifold pressure sensor 116 coupled to intake manifold 44; and a profile ignition pickup signal (PIP) from Hall effect sensor 118 coupled to crankshaft 40.

Figure 2:
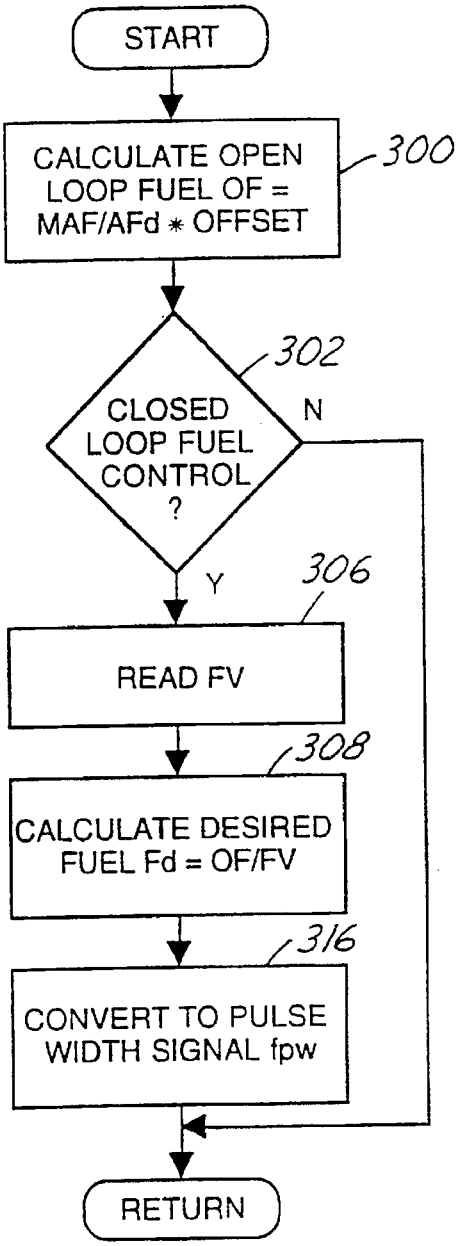

The liquid fuel delivery routine executed by controller 12 for controlling engine 10 is now described beginning with reference to the flowchart shown in FIG. 2. An open loop calculation of desired liquid fuel (signal OF) is calculated in step 300. More specifically, the measurement of inducted mass airflow (MAF) from sensor 110 is divided by desired air/fuel ratio AFd which, in this example, is correlated with stoichiometric combustion. The resulting quotient is multiplied by signal OFFSET. As described in greater detail later herein with particular reference to FIGS. 4 and 5, signal OFFSET will offset engine air/fuel operation in either a rich direction or a lean direction to help locate the peak efficiency window of converter 20. When signal OFFSET is at unity, no fuel offset is provided.

Continuing with FIG. 2, a determination is made that closed loop or feedback control is desired (step 302) by monitoring engine operating parameters such as temperature ECT. Feedback variable FV is read (step 306) from the subroutine described later herein with reference to FIG. 3. Desired fuel quantity, or fuel command, for delivering fuel to engine 10 is generated by dividing feedback variable FV into the previously generated open loop calculation of desired fuel (signal OF) as shown in step 308. Fuel command or desired fuel signal Fd is then converted to pulse width signal fpw (step 316) for actuating fuel injector 68.

Controller 12 executes an air/fuel feedback routine to generate feedback variable FV as now described with reference to the flowchart shown in FIG. 3. In general, feedback variable FV is generated each background loop of controller 12 by a proportional plus integral (PI) controller responsive to exhaust gas oxygen sensor 16. The integration steps for integrating signal EGOS in a direction to cause a lean air/fuel correction are provided by integration steps Δi, and the proportional term for such correction provided by $P_i$. Similarly,integral term Δj and proportional term Pj cause rich air/fuel correction.

Initial conditions which are necessary before feedback control is commenced, such as temperature ECT being above a preselected value, are first checked in step 500. It is then determined whether the air/fuel feedback should provide an air/fuel bias (502). If the desire air/fuel bias is zero, both integral terms (Δi and Δj) are set equal and both proportional terms (Pi and Pj) are set equal during step 504. If a rich bias is desired (502, 508), proportional term Pj is incremented by bias amount B (510). If a lean bias is desired (502, 508), proportional term Pi is incremented by bias amount B (512).

Figure 3:
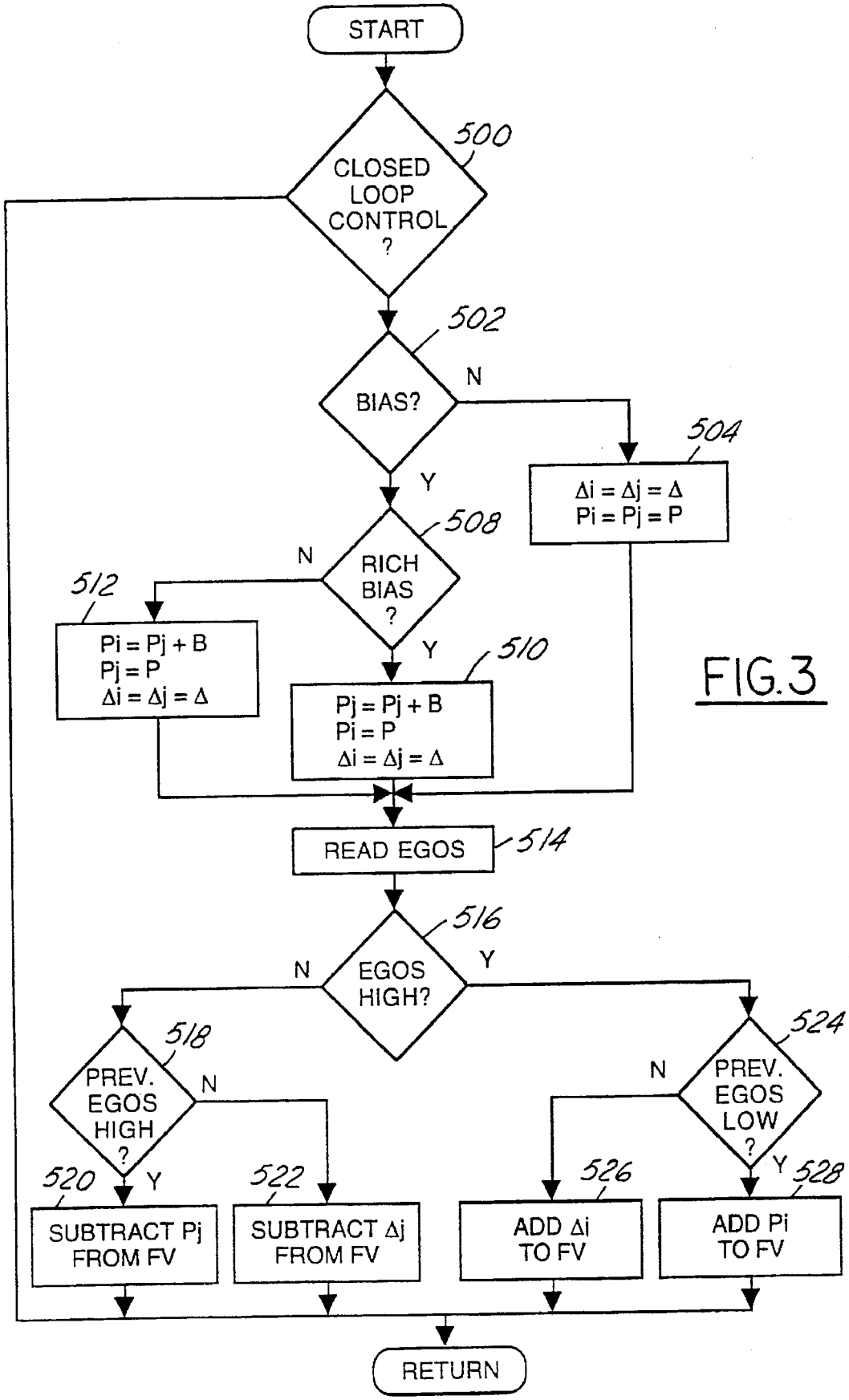

Continuing with FIG. 3, when signal EGOS is low (step 516), but was high during the previous background loop of controller 12 (step 518), preselected proportional term Pj is subtracted from feedback variable FV (step 520). When signal EGOS is low (step 516), and was also low during the previous background loop (step 518), preselected integral term Δj, is subtracted from feedback variable FV (step 522).

Similarly, when signal EGOS is high (step 516), and was also high during the previous background loop of controller 12 (step 524), integral term Δi is added to feedback variable FV (step 526). When signal EGOS is high (step 516), but was low during the previous background loop (step 524), proportional term Pi is added to feedback variable FV (step 528).

Figure 4A:
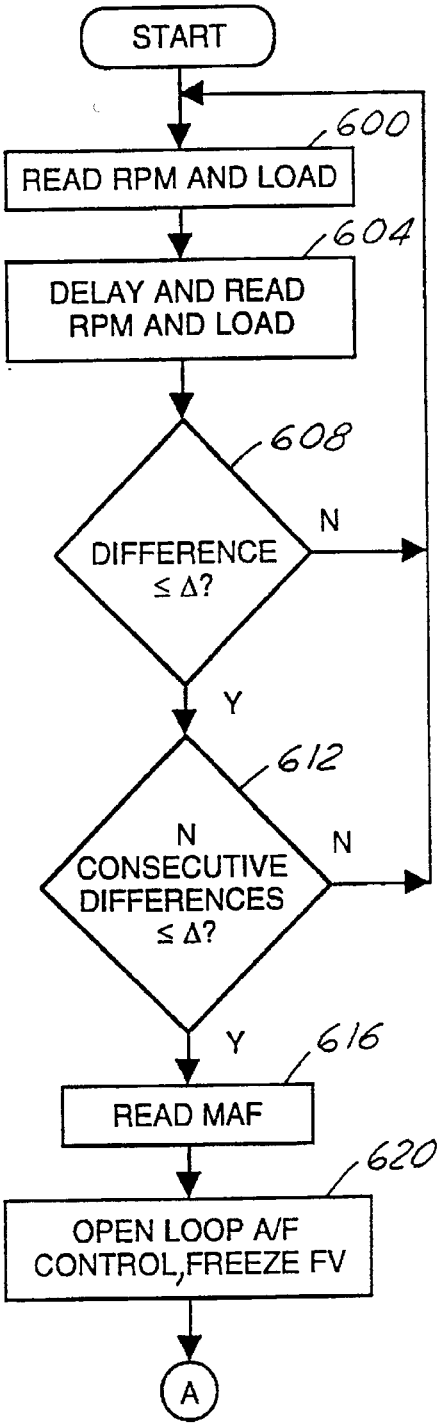
Figure 4B:
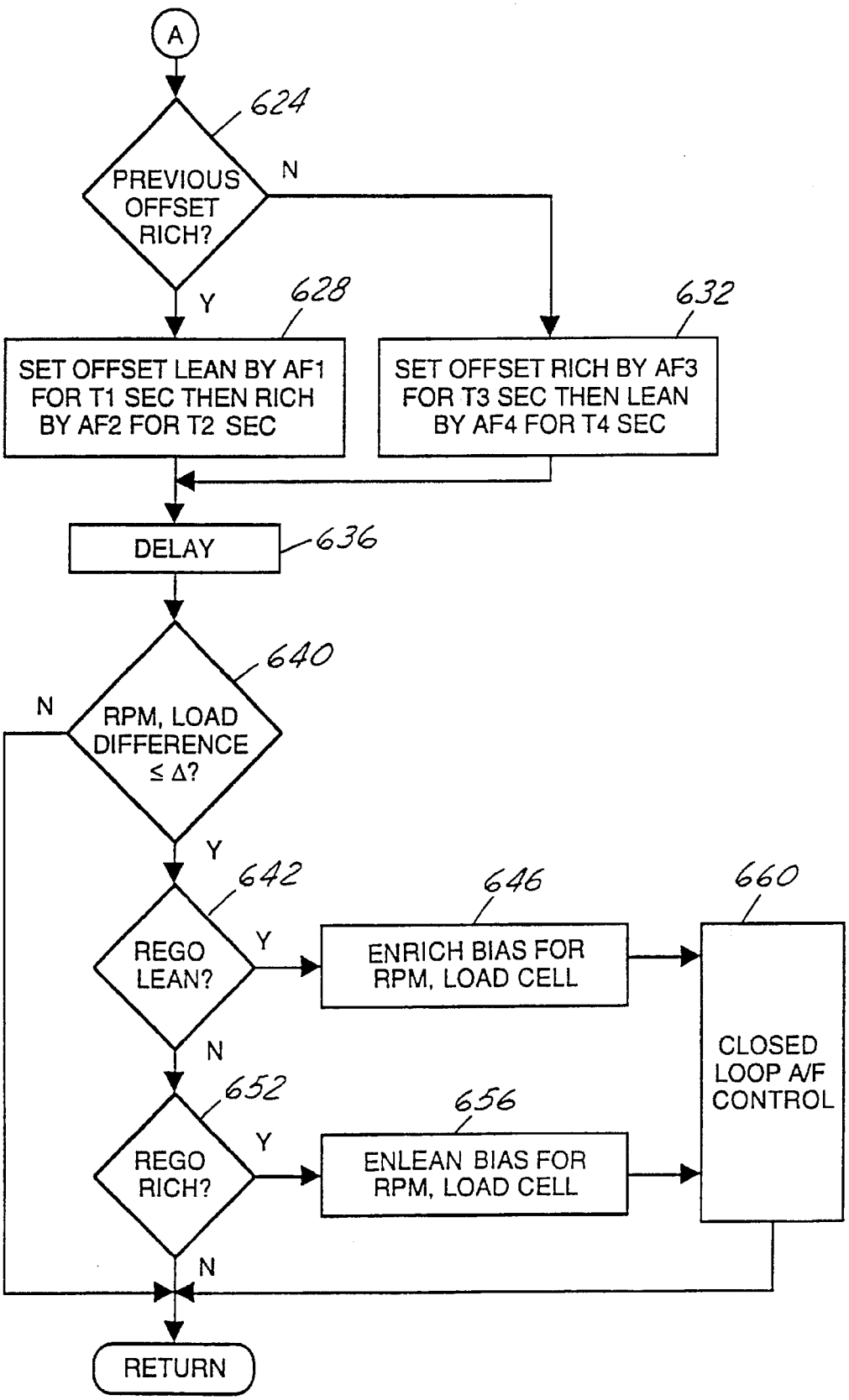

The subroutine for generating rich and lean air/fuel bias values is now described with particular reference to FIG. 4. Because bias values are generated for each of a plurality of engine rpm and load cells, the subroutine first determines when engine 10 is operating in a particular rpm, load cell for a preselected time.

Engine rpm and load are read during step 600, read again during step 604 after a preselected delay time, and the difference between successive rpm and load values determined in step 608. When these differences are less than a preselected value (Δ) for "N" consecutive trials (612), the subroutine for generating bias values described below commences.

A measurement of airflow inducted into engine 10 is read (MAF) during step 616. Open loop air/fuel control then commences during step 620 by freezing feedback variable FV to its previous value.

Figure 5:
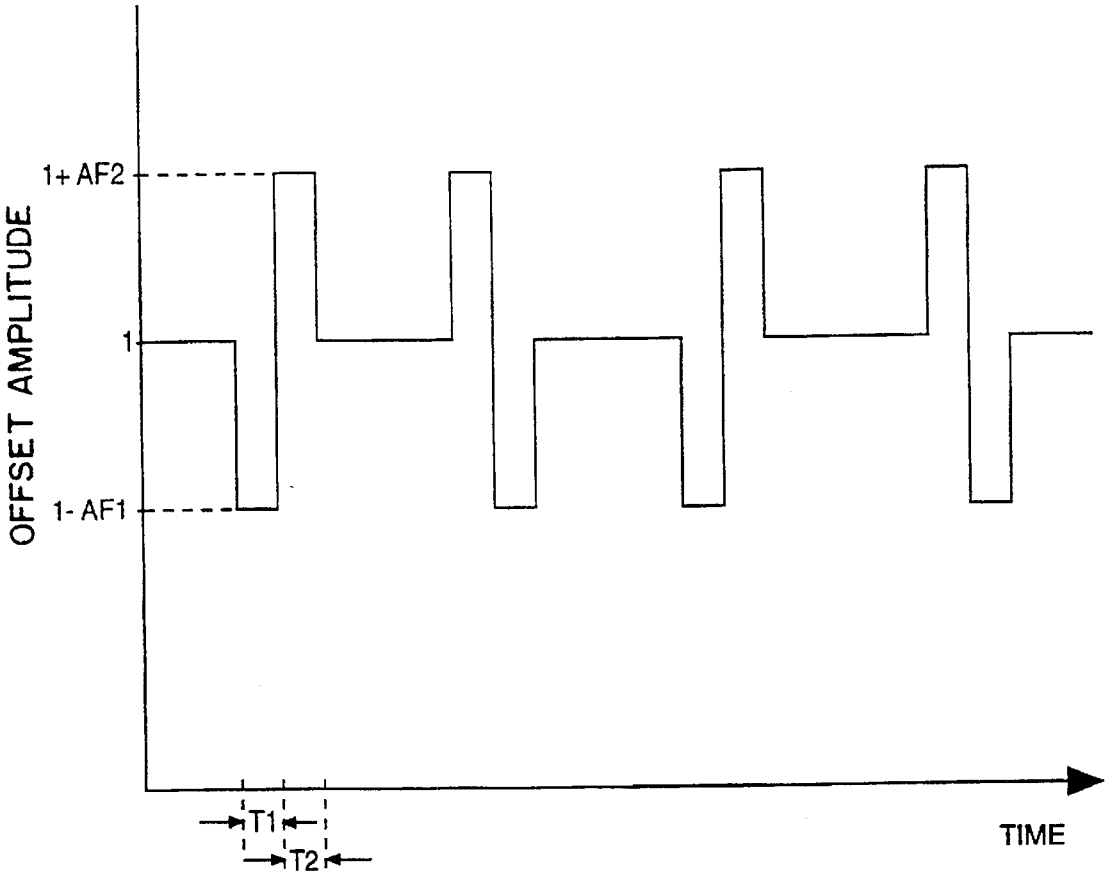
FIG. 5 illustrates a typical offsetting signal used to advantage by a portion of the embodiment shown in FIG. 1.

Signal OFFSET is generated as shown by the waveform illustrated in FIG. 5. As previously described with particular reference to FIG. 2, engine air/fuel ratio is offset in either a rich or a lean direction dependent upon the value of signal OFFSET. When signal OFFSET is at unity, no air/fuel offset is provided. In general, signal OFFSET is modulated between a lean offset and a rich offset to determine whether the resulting excursion in exhaust emissions has exceeded the peak efficiency window of catalytic converter 20. Such an indication is provided by downstream exhaust gas oxygen sensor 22 a predetermined time after the offset is provided. This predetermined time is substantially equal to the time required for an air/fuel mixture to propagate through engine 10, exhaust manifold 48, and catalytic converter 20 to exhaust gas oxygen sensor 22.

Continuing with FIG. 4, when the previous signal OFFSET was rich (624), signal OFFSET is set lean by amplitude AF1 for T1 seconds (628). Immediately thereafter, signal OFFSET is set rich by amplitude AF2 for T2 seconds to compensate for the effect of the previous lean offset. Downstream exhaust gas oxygen sensor 22 is read (642 and 652) after the predetermined delay time following introduction of the lean offset (636), provided that engine rpm and load remain within deviation Δ of the previous rpm and load values (640). If the lean offset is detected by downstream exhaust gas sensor 22, signal REGOS will indicate a lean value (642) and the bias value for this particular rpm and load cell will be incremented if it was rich, or decremented if it was previously lean (step 646). If the bias value was previously zero, it will be changed to a slightly rich value.

Operation proceeds in a similar manner when a rich offset is provided by signal OFFSET. More specifically, during step 632, signal OFFSET is offset rich by amplitude AF3 for T3 seconds. Immediately thereafter, signal OFFSET is reset by a lean offset (AF4) for T4 seconds to counteract the effect of the previous rich offset (632). Downstream exhaust gas oxygen sensor 22 is then sampled during step 652 after a delay time (636) correlated with propagation of the rich offset in air/fuel mixture through engine 10, exhaust manifold 48, and catalytic converter 20, provided that engine rpm and load have not changed by more than difference Δ. If the rich offset is detected by output signal REGOS from downstream sensor 22 (652), the bias value for this particular speed and load cell will be decremented if it was previously rich, or incremented if it was previously lean (step 656). If the bias value was previously zero, it will be changed to a slightly lean value. After the bias term is modified (656 or 646), closed loop air/fuel control is resumed (step 660) wherein feedback variable FV is generated by the subroutine previously described with particular reference to FIG. 3.

This concludes the description of an embodiment in which the invention is used to advantage. The reading of it by those skilled in the art would bring to mind many alterations and modifications without departing from the spirit and scope of the invention. Accordingly, it is intended for the scope of the invention be limited by the following claims.

What is claimed:

1. An air/fuel control method for an engine responsive to first and second exhaust gas oxygen sensors positioned in the engine exhaust respectively upstream and downstream of a catalytic converter, comprising the steps of:

generating a fuel flow signal to cause engine air/fuel operation near a desired air/fuel ratio;

trimming said fuel flow signal by a feedback variable derived from the first sensor;

disabling said trimming step and offsetting said fuel flow signal by a first value during a first predetermined time to cause a corresponding rich offset in engine air/fuel operation and offsetting said fuel flow signal during a second predetermined time by a second value to cause a corresponding lean offset in engine air/fuel operation; and biasing said fuel flow signal with a rich fuel bias when the second sensor indicates excessively lean engine exhaust in response to said lean fuel offset and biasing said fuel flow signal with a lean fuel bias when the second sensor indicates excessively rich exhaust gases in response to said rich fuel offset.

2. The method recited in claim 1 wherein said fuel flow signal has an amplitude proportional to an indication of inducted airflow.

3. The method recited in claim 1 wherein said second value offsetting step follows said first value offsetting step by a third predetermined time.

4. The method recited in claim 1 wherein said first predetermined and said second predetermined times are a function of an indication of airflow inducted into the engine.

5. The method recited in claim 1 wherein said feedback variable is derived by adding an integration of an output of the sensor to a product of a proportional term times said sensor output.

6. The method recited in claim 5 wherein said biasing step comprises modifying said proportional term.

7. An air/fuel control method for an engine responsive to first and second exhaust gas oxygen sensors positioned in the engine exhaust respectively upstream and downstream of a catalytic converter, comprising the steps of:

generating a fuel flow signal having an amplitude proportional to an indication of inducted airflow to cause engine air/fuel operation near a desired air/fuel ratio;

trimming said fuel flow signal by a feedback variable derived from the first sensor;

disabling said trimming step, offsetting said fuel flow signal by a first value during a first predetermined time to cause a corresponding rich offset in engine air/fuel operation and immediately thereafter offsetting said fuel flow signal in a lean air/fuel direction to cancel said rich offset, and offsetting said fuel flow signal during a second predetermined time by a second value to cause a corresponding lean offset in engine air/fuel operation and immediately thereafter offsetting said fuel flow signal in a rich air/fuel direction to cancel said lean offset; and biasing said fuel flow signal with a rich fuel bias when the second sensor indicates excessively lean engine exhaust in response to said lean fuel offset and biasing said fuel flow signal with a lean fuel bias when the second sensor indicates excessively rich exhaust gases in response to said rich fuel offset.

8. The method recited in claim 7 wherein said second value offsetting step follows said first value offsetting step by a third predetermined time.

9. The method recited in claim 7 wherein said first predetermined and said second predetermined times are a function of an indication of airflow inducted into the engine.

10. An electronic memory containing a computer program to be executed by an engine controller which controls an engine responsive to first and second exhaust gas oxygen sensors positioned in the engine exhaust respectively upstream and downstream of a catalytic converter, comprising:

fuel means for generating a fuel flow signal having an amplitude proportional to an indication of inducted airflow to cause engine air/fuel operation near a desired air/fuel ratio;

feedback means for trimming said fuel flow signal by a feedback variable derived from the first sensor;

offset means for disabling said trimming step, offsetting said fuel flow signal by a first value during a first predetermined time to cause a corresponding rich offset in engine air/fuel operation and immediately thereafter offsetting said fuel flow signal in a lean air/fuel direction to cancel said rich offset, and offsetting said fuel flow signal during a second predetermined time by a second value to cause a corresponding lean offset in engine air/fuel operation and immediately thereafter offsetting said fuel flow signal in a rich air/fuel direction to cancel said lean offset; and biasing means for biasing said fuel flow signal with a rich fuel bias when the second sensor indicates excessively lean engine exhaust in response to said lean fuel offset and biasing said fuel flow signal with a lean fuel bias when the second sensor indicates excessively rich exhaust gases in response to said rich fuel offset.

11. The electronic memory recited in claim 10 wherein the program is stored in an electronically programmable chip.

* * * * *